US008391749B2

(12) United States Patent
Inoue

(10) Patent No.: US 8,391,749 B2
(45) Date of Patent: Mar. 5, 2013

(54) IMAGE FORMING APPARATUS, IMAGE FORMING UNIT, AND ERASE LIGHT CONTROL METHOD

(75) Inventor: Keisuke Inoue, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 373 days.

(21) Appl. No.: 12/725,765

(22) Filed: Mar. 17, 2010

(65) Prior Publication Data

US 2010/0239280 A1 Sep. 23, 2010

(30) Foreign Application Priority Data

Mar. 18, 2009 (JP) ..... 2009-65535

(51) Int. Cl.
*G03G 21/00* (2006.01)
*G03G 15/00* (2006.01)

(52) U.S. Cl. ..... 399/128; 399/38; 399/44; 399/45

(58) Field of Classification Search ..... 399/38, 399/44, 45, 128, 186
See application file for complete search history.

(56) References Cited

U.S. PATENT DOCUMENTS

| | | | | |
|---|---|---|---|---|
| 6,070,032 | A * | 5/2000 | Rokutanda et al. | 399/128 |
| 6,115,560 | A * | 9/2000 | Kuek et al. | 399/45 |
| 6,269,228 | B1 * | 7/2001 | Kayahara et al. | 399/37 |
| 6,826,375 | B2 * | 11/2004 | Kitajima | 399/50 |
| 7,463,849 | B2 * | 12/2008 | Takuma et al. | 399/128 |

FOREIGN PATENT DOCUMENTS

| | | | |
|---|---|---|---|
| JP | 07-152295 | * | 6/1995 |
| JP | 2003-76076 | A | 3/2003 |
| JP | 2003-084527 | | 3/2003 |
| JP | 2005-208223 | A | 8/2005 |
| JP | 2006-078684 | | 3/2006 |
| JP | 2009-008906 | | 1/2009 |
| JP | 2009-031488 | | 2/2009 |

OTHER PUBLICATIONS

Office Action (Notification of Reason for Refusal) dated Feb. 1, 2011, issued in the corresponding Japanese Patent Application No. 2009-065535, and an English Translation thereof.

* cited by examiner

*Primary Examiner* — Sandra Brase
(74) *Attorney, Agent, or Firm* — Buchanan Ingersoll & Rooney PC

(57) ABSTRACT

Electric charge remaining on a photoreceptor after transfer causes image deterioration. According to one conventional method widely used in view of this problem, erase light is emitted onto a photoreceptor after the transfer to remove the electric charge remaining on the photoreceptor. However, such a method poses the following problem: emission of erase light leads to light-induced fatigue of the photoreceptor, and as a result, the photoreceptor which has deteriorated from the light-induced fatigue wears down due to abrasion and the like with a cleaner blade, resulting in a shorter lifetime of the photoreceptor. Thus, the thickness of the photosensitive layer is detected to acquire the amount of thickness decrease, and the amount of the erase light is reduced according to the acquired amount of thickness decrease.

22 Claims, 16 Drawing Sheets

FIG. 6

| | Thickness (μm) | | Thickness decrease (d) (μm) |
|---|---|---|---|
| | Endurance sheet count | | |
| | 0 | 600000 | |
| Erase light emitted | 27.5 | 23.9 | 3.6 |
| No erase light emitted | 27.5 | 26.3 | 1.2 |

FIG. 7

| Amount of thickness decrease (d) (μm) | d < d1 | d1 ≦ d ≦ d2 | d2 < d |
|---|---|---|---|
| Thickness erase light voltage | Vd1 | Vd2 | Vd3 |
| Amount of erase light (μW) | Er1 | Er2 | Er3 |

(d1<d2)
(23.6≦Er3<Er2<Er1≦110)

FIG. 10

| | | Temperature (℃) | | | | | | |
|---|---|---|---|---|---|---|---|---|
| | | <16 | <20 | <24 | <28 | <32 | <44 | 44≦ |
| Relative humidity (%) | <18 | 1 | 1 | 1 | 1 | 1 | 1 | 1 |
| | <32 | 1 | 1 | 1 | 1 | 2 | 2 | 3 |
| | <55 | 2 | 3 | 3 | 4 | 4 | 4 | 5 |
| | <65 | 2 | 3 | 4 | 4 | 4 | 5 | 5 |
| | <75 | 3 | 3 | 4 | 4 | 5 | 5 | 6 |
| | <85 | 4 | 4 | 5 | 5 | 6 | 6 | 7 |
| | 85≦ | 5 | 6 | 6 | 7 | 7 | 8 | 8 |

FIG. 11

| | | Environment coefficient |
|---|---|---|
| Environment step | 1 | K1 |
| | 2 | K2 |
| | 3 | K3 |
| | 4 | K4 |
| | 5 | K5 |
| | 6 | K6 |
| | 7 | K7 |
| | 8 | K8 |

$(0 < K8 < K7 < K6 < K5 < K4 < K3 < K2 < K1 = 1)$

FIG. 15

| Case No. | Position of photoreceptor | Toner | Thickness (μm) | | Thickness decrease (μm) |
|---|---|---|---|---|---|
| | | | Endurance sheet count 0 | Endurance sheet count 20000 | |
| Case 1 | P1 | Y | 27.85 | 27.06 | 0.79 |
| | P2 | M | 27.65 | 27.27 | 0.38 |
| | P3 | C | 28.09 | 28.03 | 0.06 |
| | P4 | K | 27.57 | 27.20 | 0.37 |
| Case 2 | P1 | C | 27.81 | 26.98 | 0.83 |
| | P2 | M | 27.73 | 27.04 | 0.69 |
| | P3 | Y | 27.95 | 27.24 | 0.71 |
| | P4 | K | 27.89 | 27.39 | 0.50 |

IMAGE FORMING APPARATUS, IMAGE FORMING UNIT, AND ERASE LIGHT CONTROL METHOD

This application is based on application No. 2009-065535 filed in Japan, the content of which is hereby incorporated by references.

BACKGROUND OF THE INVENTION (1) Field of the Invention

The present invention relates to an image forming apparatus, and in particular to a technique to reduce deterioration of a photoreceptor due to light-induced fatigue while also maintaining an image quality by neutralizing and erasing electric charge remaining on the photoreceptor by emitting erase light prior to charging.

(2) Description of the Related Art

Image forming apparatuses using an electrophotographic system charge a surface of a photoreceptor to a uniform electric potential with use of a charger, forms a latent image by exposure scanning using a laser beam, develops the latent image using toner, and transfers the developed toner image onto a recording sheet.

However, when the toner image formed on the photoreceptor is transferred, the following phenomenon occurs: a transfer current concentrates at a non-exposure portion (dark portion) where toner does not exist, and electric charge remains at a portion where toner exists (light portion). It is difficult to uniformly charge the surface of the photoreceptor with electric charge remaining thereon partially. As a result, a previous image may appear, as hysteresis (in this specification, referred to as "photoreceptor memory"), in the latent image and the toner image that results from development of the latent image, in the subsequent image forming process. This leads to deterioration in the image quality.

Accordingly, a conventional method of irradiating the photoreceptor with a predetermined light (in this specification, referred to as "erase light") after the toner image is transferred, to neutralize the potential on the photoreceptor, and subsequently charging the photoreceptor for the next image formation is widely adopted.

The surface of photoreceptors suffers abrasion due to such as a cleaning operation, and the photosensitive layer suffers fatigue, deterioration, and the like. Thus, the lifetime of photoreceptors is limited to a particular period of time, and exposure by erase light is considered to be a factor affecting the lifetime of the photoreceptors.

Specifically, in recent years, Organic Photoconductors (OPC) using organic photosensitive materials are widely used. Although such organic photoreceptors (photoconductors) have advantages in, for example, cost, productivity, and low-pollution characteristics, they are susceptible to light-induced fatigue due to emission of the erase light. The surface of the photoreceptor with light-induced fatigue readily wears down due to a cleaning operation and the like.

Here, as disclosed in, for example, Japanese Laid-Open Patent Application Publication No. 2003-76076 and Japanese Laid-Open Patent Application Publication No. 2005-208223, output of the erase light may be suppressed to decrease image deterioration due to the photoreceptor memory so as to extend the lifetime of the photoreceptor.

However, the degree of the photoreceptor memory is considered to be affected by various factors including a usage environment. Particularly, in image forming apparatuses that have multiple photoreceptors and form a color image by transferring toner images formed on the photoreceptors by multiple transfer, the degree of the photoreceptor memory is considered to be affected by the positions of the photoreceptors.

SUMMARY OF THE INVENTION

The present invention aims to realize, in an image forming apparatus having multiple photoreceptors, suppression of image deterioration due to a photoreceptor memory while also efficiently extending the lifetime of the photoreceptors.

According to the study conducted by the inventors of the present invention, the degree of the photoreceptor memory and the degree of the image deterioration due to the photoreceptor memory are largely affected by the thickness of the photosensitive layer at the surface of the photoreceptor. The inventors found the following: as the thickness of the photosensitive layer wears down and becomes thinner, the charge retention ability of the photoreceptor declines, and as a result, the residual electric charge on the photoreceptor becomes smaller, and the photoreceptor memory becomes smaller accordingly.

Thus, in order to achieve the above-stated aim, one aspect of the present invention is an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming apparatus comprising: an erase light emitter operable to emit, onto each of the photoreceptors, erase light for neutralizing electric charge remaining on a surface of the photoreceptor after transfer, wherein an amount of the erase light emitted onto the photoreceptor is determined based on a predetermined condition pertaining to a thickness of a photosensitive layer of the photoreceptor.

In order to achieve the above-stated aim, another aspect of the present invention is an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming apparatus comprising: an erase light emitter operable to emit, onto each of the photoreceptors, erase light for neutralizing electric charge remaining on a surface of the photoreceptor after transfer, wherein an amount of the erase light emitted onto one of the photoreceptors, on which a toner image in yellow is formed is lower than an amount of the erase light emitted onto any other of the photoreceptors on which a toner image in a color other than yellow is formed.

In order to achieve the above-stated aim, another aspect of the present invention is an image forming apparatus that forms a latent image on a photoreceptor based on image data, generates a toner image by developing the latent image using a toner, and transfers the toner image onto a transfer material, the image forming apparatus comprising: an erase light emitter operable to emit, onto the photoreceptor, erase light for neutralizing electric charge remaining on a surface of the photoreceptor after transfer, wherein an amount of the erase light is determined based on a process speed of image formation.

In order to achieve the above-stated aim, another aspect of the present invention is an image forming unit in an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming unit comprising: an erase light emitter operable to emit, onto each of the photoreceptors, erase light for neutralizing electric charge remaining on a surface of the photoreceptor after transfer, wherein an amount of the erase light emitted onto the photoreceptor is determined based on a predetermined condition pertaining to a thickness of a photosensitive layer of the photoreceptor.

In order to achieve the above-stated aim, another aspect of the present invention is an image forming unit in an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming unit comprising: an erase light emitter operable to emit, onto each of the photoreceptors, erase light for neutralizing electric charge remaining on a surface of the photoreceptor after transfer, wherein an amount of the erase light emitted onto one of the photoreceptors, on which a toner image in yellow is formed is lower than an amount of the erase light emitted onto any other of the photoreceptors on which a toner image in a color other than yellow is formed.

In order to achieve the above-stated aim, another aspect of the present invention is an image forming unit in an image forming apparatus that forms a latent image on a photoreceptor based on image data, generates a toner image by developing the latent image using a toner, and transfers the toner image onto a transfer material, the image forming unit comprising: an erase light emitter operable to emit, onto the photoreceptor, erase light for neutralizing electric charge remaining on a surface of the photoreceptor after transfer, wherein an amount of the erase light is determined based on a process speed of image formation.

In order to achieve the above-stated aim, another aspect of the present invention is an erase light control method executed by an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the erase light control method comprising: a determining step of determining, for each of the photoreceptors, an amount of erase light for neutralizing electric charge remaining on a surface of the photoreceptor after transfer, in accordance with a predetermined condition pertaining to a thickness of a photosensitive layer of the photoreceptor; and an erase light emitting step of emitting, onto each of the photoreceptors, the amount of the erase light determined in the determining step.

In order to achieve the above-stated aim, another aspect of the present invention is an erase light control method executed by an image forming apparatus that forms a latent image on a photoreceptor based on image data, generates a toner image by developing the latent image using a toner, and transfers the toner image onto a transfer material, the erase light control method comprising: a determining step of determining an amount of erase light for neutralizing electric charge remaining on a surface of the photoreceptor after transfer, in accordance with a process speed of image formation, and an erase light emitting step of emitting the amount of the erase light determined in the determining step.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6 is a table showing a difference in thickness decrease depending on whether erase light is emitted or not;

FIG. 7 is a table showing correspondence among an amount of thickness decrease, a thickness erase light voltage, and an amount of erase light in a first embodiment of the present invention;

FIG. 10 is a table showing correspondence between an environment step, a temperature, and a relative humidity in a second embodiment of the present invention, the environment step being an index indicating an absolute humidity;

FIG. 11 is a table showing correspondence between the environment step and an environment coefficient in the second embodiment of the present invention;

FIG. 15 is a chart showing relationships between the photosensitive drums and an amount of thickness decrease.

DESCRIPTION OF THE PREFERRED EMBODIMENT

The following describes embodiments of an image forming apparatus by way of example of a tandem-type color digital printer using a multilayer OPC photoreceptor (in this specification, referred to as simply "printer").

First Embodiment

1-1. Overall Structure of Printer

Figure 1:
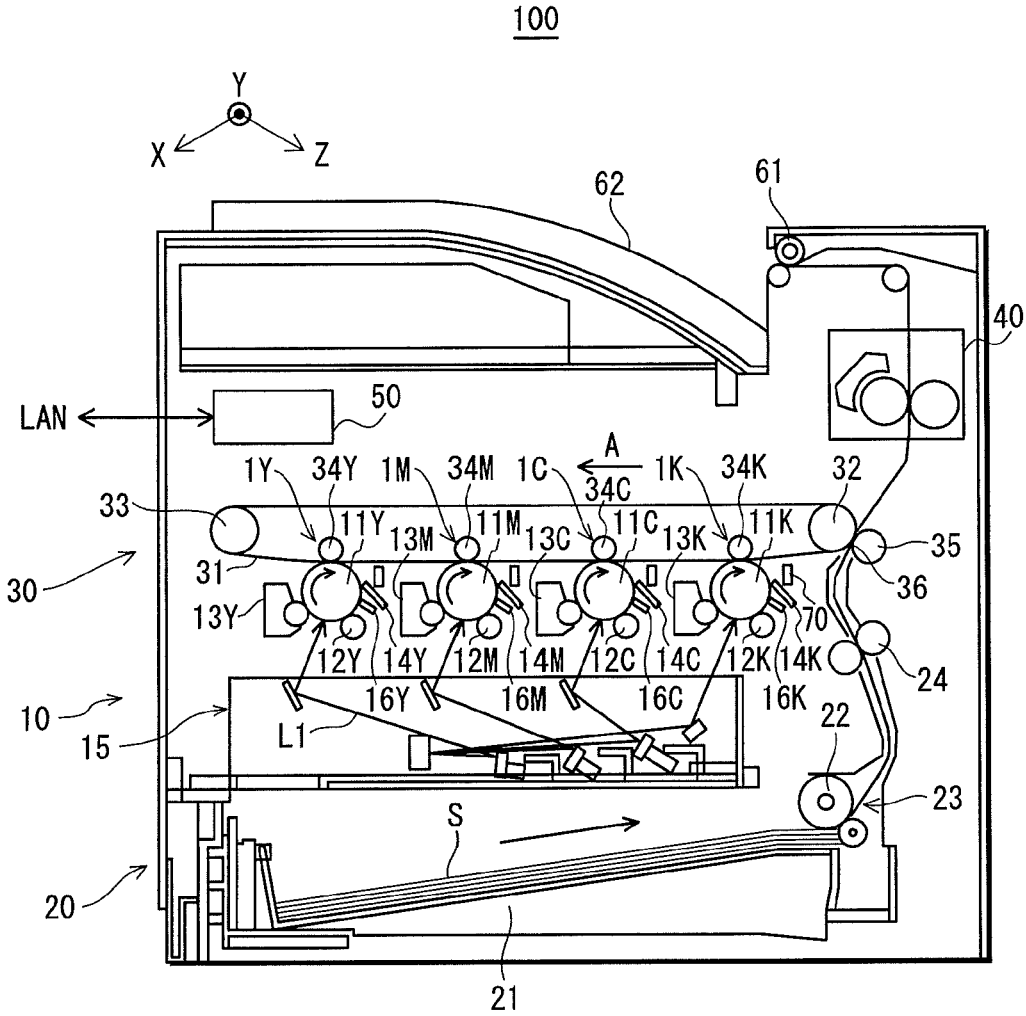
FIG. 1 shows an overall structure of an image forming apparatus pertaining to embodiments of the present invention.

FIG. 1 is a schematic diagram showing an overall structure of a printer 100 pertaining to the present embodiment. The printer 100 is configured to include an image former 10, a paper feeder 20, a transfer part 30, a fixing device 40, a controller 50, and the like.

The printer 100 is connected to a network (e.g. LAN: Local Area Network). Upon receiving a print job execution instruction from an external terminal apparatus (not shown), the printer 100 executes full-color image formation, in accordance with the instruction, by forming toner images respectively of colors cyan, magenta, yellow, and black, and transferring the formed toner images by multiple transfer.

The cyan, magenta, yellow, and black reproduction colors are represented as C, M, Y, and K respectively in this specification, and the letters C, M, Y, and K are appended to numbers pertaining to the reproduction colors.

The image former 10 includes image forming units 1C, 1M, 1Y, and 1K, an optical part 15, an intermediate transfer belt 31, and the like.

The intermediate transfer belt 31 is an endless belt that is suspended in a tensioned state on a driving roller 32 and a driven roller 33, and is driven to rotate in the direction of an arrow A.

The optical part 15 includes a luminous element such as laser diode. The optical part 15 emits a laser beam L1 according to drive signals from the controller 50 for performing exposure scanning on the photosensitive drums (photoreceptors) 11C, 11M, 11Y, and 11K to form images of the colors C, M, Y, and K.

The exposure scanning forms an electrostatic latent image on the photosensitive drums 11C, 11M, 11Y, and 11K charged by charging rollers 12C, 12M, 12Y, and 12K. The electrostatic latent images are developed by developers 13C, 13M, 13Y, and 13K, respectively. The toner images of the colors C, M, Y, and K on the photosensitive drums 11C, 11M, 11Y, and 11K are primarily transferred at different timings to be superimposed on the same position on the intermediate transfer belt 31.

A full-color toner image is formed as a result of sequential transfers of the toner images of the respective colors onto the intermediate transfer belt 31 due to electrostatic force provided by primary transfer rollers 34C, 34M, 34Y, and 34K, and the full-color toner image is transported toward a secondary transfer position 36 according to the rotation of the intermediate transfer belt 31.

The paper feeder 20 includes such as the following: a paper feed cassette 21 accommodating sheets S; a feeding roller 22 which feeds the sheets S from the paper feed cassette 21 one sheet at a time toward the secondary transfer position 36; and a timing roller pair 24 for controlling the timing to send the fed sheet S to the secondary transfer position 36. The paper feeder 20 feeds a sheet S therefrom to the secondary transfer position 36 in concert with the transport timing of the toner images on the intermediate transfer belt 31. Subsequently, the toner images on the intermediate transfer belt 31 are collectively secondarily transferred onto the sheet S by electrostatic force of the secondary transfer roller 35.

Having passed the secondary transfer position 36, the sheet S is further conveyed to the fixing device 40, and the toner image (unfixed image) on the sheet S is fixed to the sheet S by the fixing device 40 with application of heat and pressure. After that, the sheet with the image fixed thereon is discharged to a discharge tray 62 via a discharge roller pair 61.

The controller 50 executes communication with external terminal, image processing, drive controls of the above-described components, and the like.

An operation panel 2 (see FIG. 2) is provided at an easily operable position at an upper portion of the front surface of the printer 100. The operation panel 2 is equipped with a numerical keypad for inputting the number of copies, a copy start key for instructing the start of copying, a key for selecting an image forming mode, and in addition, a touch-panel liquid crystal display unit. The liquid crystal display unit displays a message screen indicating the status of the printer 100, such as, the status of waiting a job execution instruction (standby status). The selection of a paper feed tray, adjustment of copy density, and the like are performed through the touch-panel function of the liquid crystal display unit.

Figure 2:
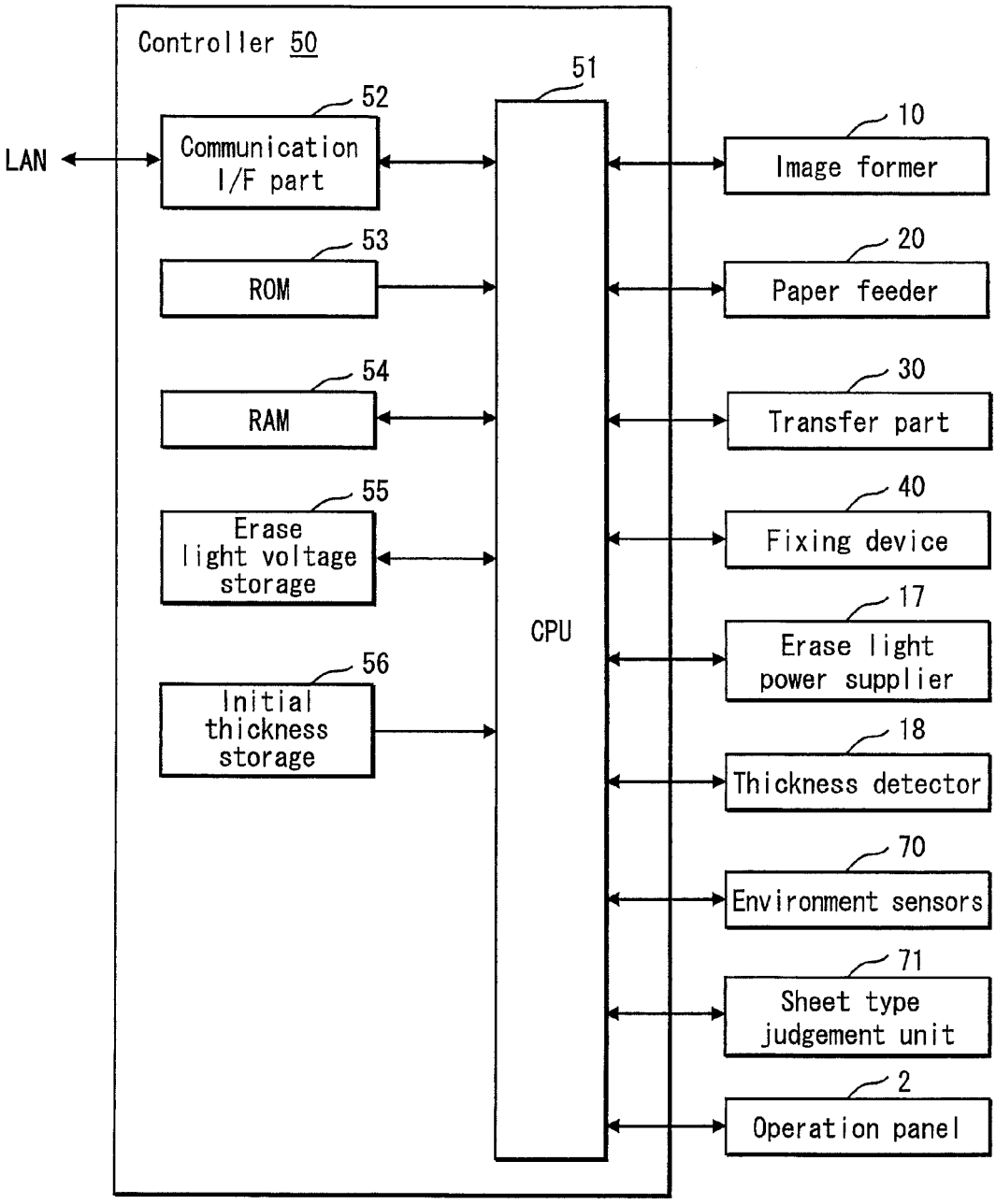
FIG. 2 is a block diagram showing a schematic structure of a controller of the image forming apparatus pertaining to the embodiments of the present invention.

FIG. 2 is a block diagram showing a structure of the controller 50. As shown in the figure, the controller 50 includes such as the following as its main components: a CPU (Central Processing Unit) 51, a communication interface (I/F) 52, a ROM (Read Only Memory) 53, a RAM (Random Access Memory) 54, an erase light voltage storage 55, and an initial thickness storage 56.

The communication interface (I/F) 52 is an interface such as a LAN card or a LAN board for connecting with the LAN, and receives print job data from the external terminals.

The CPU 51 reads necessary programs from the ROM 53 and smoothly executes a print operation based on the print job data received by the communication interface (I/F) 52 by controlling operations of the image former 10, the paper feeder 20, the transfer part 30, and the fixing device 40 in an integrated manner in accordance with appropriate timings.

The erase light voltage storage 55 is a storing means composed of a nonvolatile memory such as an EEPROM (Electrically Erasable and Programmable Read Only Memory), and stores a thickness erase light voltage, an environment coefficient and the like which will be described later.

The initial thickness storage 56 is a storing means composed of a nonvolatile memory such as an EEPROM. The initial thickness storage 56 stores a thickness of photosensitive layer of brand-new, initial-state photosensitive drum.

It should be noted that while the erase light voltage storage 55 and the initial thickness storage 56 may be separate storage units, one storage unit may have functions of both of these two storages instead.

1-2. Overall Structure of Image Forming Units

Figure 3:
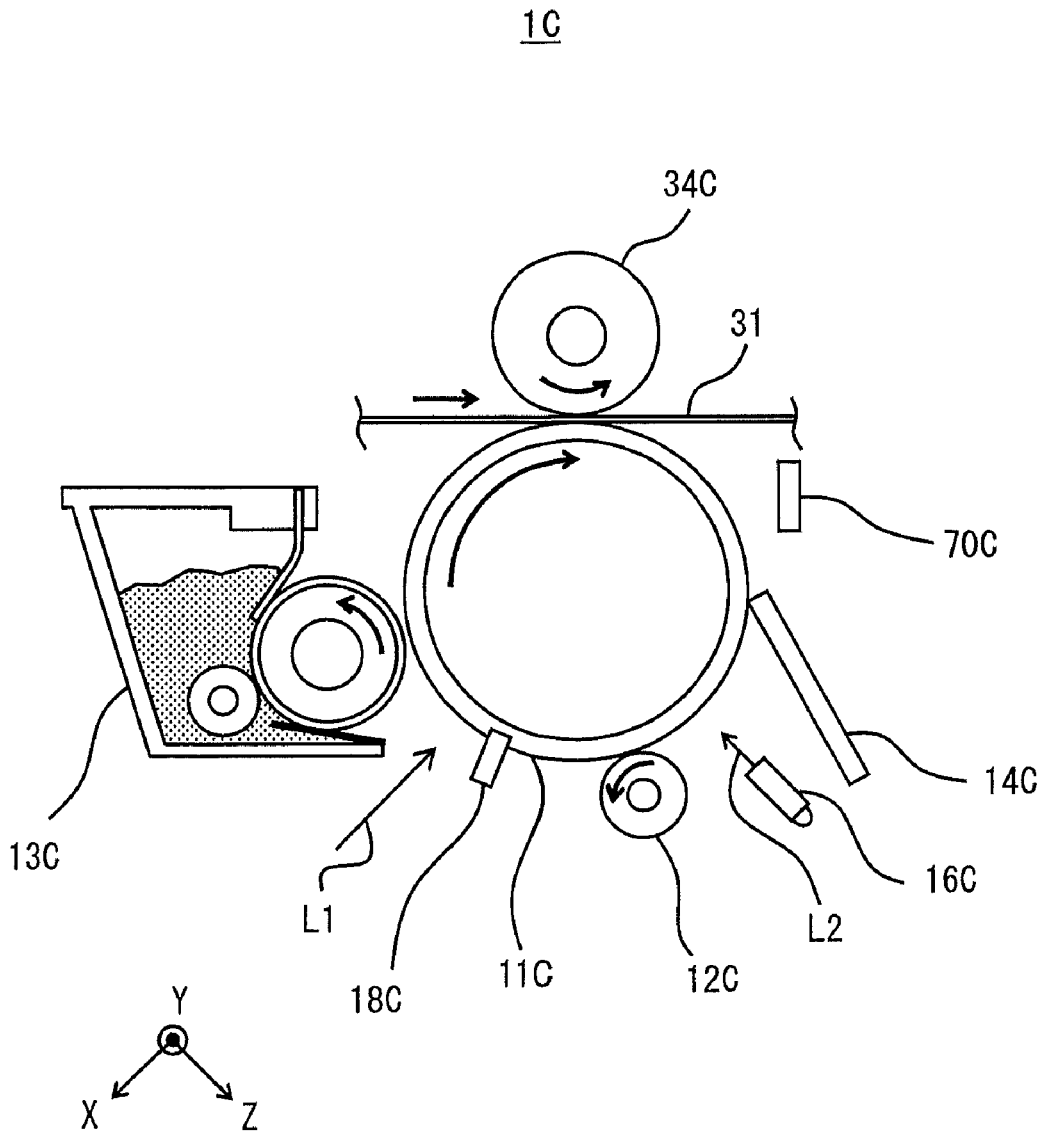
FIG. 3 schematically shows a structure of an image forming unit of the image forming apparatus pertaining to the embodiments of the present invention.

FIG. 3 is an enlarged view showing a schematic structure of the image forming unit 1C. The image forming unit 1C includes the photosensitive drum 11C, and in a vicinity of the photosensitive drum 11C, includes the charging roller 12C, the developer 13C, the primary transfer roller 34C, a cleaner blade 14C, an erase light emitter 16C, and the like. The cleaner blade 14C is for cleaning the photosensitive drum 11C. The erase light emitter 16C emits an erase light L2 for removing electric charge remaining on the photosensitive drum 11C after the transfers. The image forming unit 1C forms a toner image of the C-color on the photosensitive drum 11C. After the toner image formed on the photosensitive drum 11C is transferred onto the intermediate transfer belt 31 in the above-described manner, the photosensitive drum 11C is cleaned by the cleaning blade 14C. Residual toner, attached foreign substances, etc. on the photosensitive drum 11C are removed by the cleaning. The cleaned surface of the photosensitive drum 11C is neutralized by being uniformly exposed by the erase light L2 emitted by the erase light emitter 16C. Image formation is executed by repeating this series of processes. A thickness detector 18C measures an electric potential of the surface of a photoreceptor when a predetermined voltage is applied to the photoreceptor at a predetermined timing, and detects the thickness of the photosensitive layer based on the measured potential. The other image forming units 1M, 1Y, and 1K are configured in a similar manner to the image forming unit 1C except that the color of the toner is different, and include the charging rollers 12M, 12Y, and 12K, and the like. Note that in FIG. 3, bold arrows without any reference sign indicates the direction in which the photosensitive drum 11C, the intermediate transfer belt 31, and the rollers are driven to rotate.

1-3. Overall Structure of Erase Light Emitter

Figure 4:
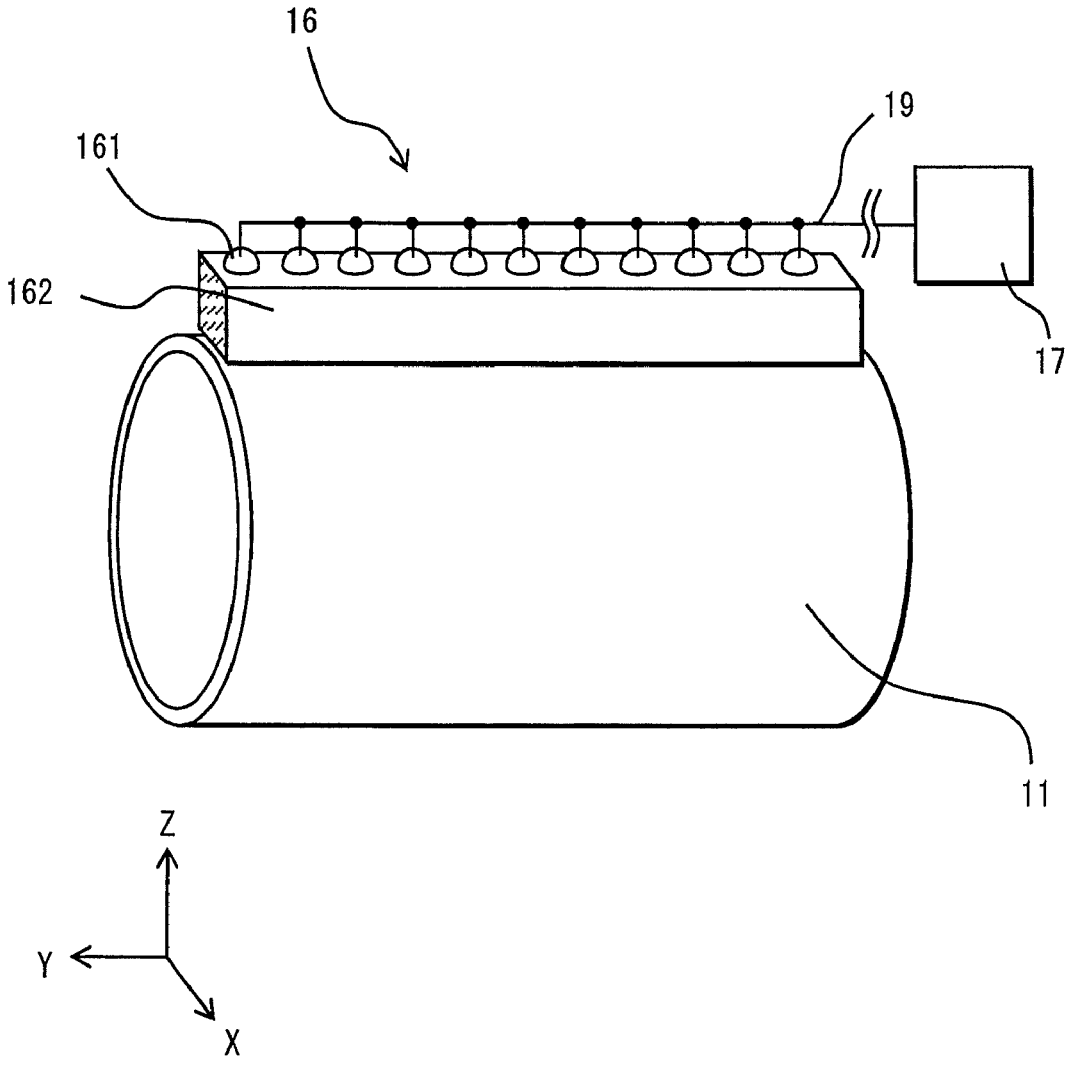
FIG. 4 is a perspective view showing a schematic structure of an erase light emitter and a positional relationship between the erase light emitter and a photosensitive drum.
Figure 5:
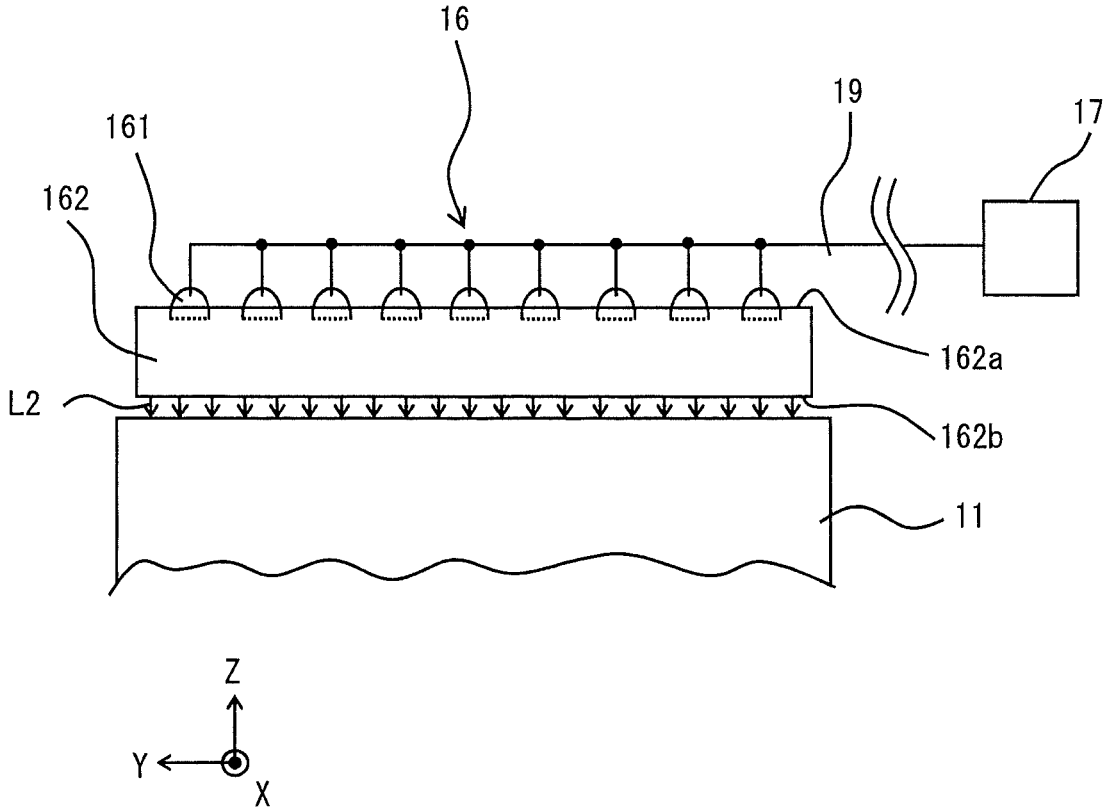
FIG. 5 is a plane diagram showing a schematic structure of the erase light emitter and a positional relationship between the erase light emitter and the photosensitive drum.

FIG. 4 is a perspective view showing a structure of an erase light emitter 16 in the present embodiment; and FIG. 5 is a plane view schematically showing major components of the erase light emitter 16 when seen from the positive direction of the X-axis.

As shown in these two figures, the erase light emitter includes: a lens array 162 which has a rectangular solid shape; multiple LED elements 161 arranged with a substantially equal interval in alignment along a light entrance surface 162*a* of the lens array 162; an erase light power supplier 17 that supplies a voltage to the LED elements 161 in a manner that the LED elements 161 emit a predetermined amount of light at a predetermined timing; and a voltage supply line 19 that electrically connects the erase light power supplier 17 and the LED elements 161.

The lens array 162 is made of lenses having a refractive index that causes diffusion light emitted by the LED elements 161 to be emitted from a light exit surface 162*b* opposing the light entrance surface 162*a*, in a direction substantially vertical to the light exit surface 162*b*.

The erase light emitter 16 is configured in a manner that the diffusion light emitted by the LED elements enters the lens array 162 from the light entrance surface 162*a*, passes through the lens array 162, and is emitted from the light exit surface 162*b* of the lens array 162, as the substantially uniform erase light L2. The erase light emitter 16 is arranged with the rectangular-shaped light exit surface 162*b* opposing the circumferential surface of the photosensitive drum 11 and the longitudinal direction of the erase light emitter 16 coinciding with the axis direction of the photosensitive drum 11. Furthermore, the lens array 162 has a sufficient length in its longitudinal direction to cover a predetermined area on the photosensitive drum 11 in which the latent image is to be formed, and is arranged to irradiate the predetermined area evenly.

In the present embodiment, a detected value of the thickness of the photosensitive layer of each photosensitive drum 11 is sent to the CPU 51 (see FIG. 2). The CPU 51 then calculates amounts of thickness decreases (d). A supply voltage to each erase light emitter 16 is determined referring to a table shown in FIG. 7 (described later) based on the calculated amount of thickness decrease (in this specification, the determined voltage is referred to as "thickness erase light voltage"), and the CPU 51 causes the erase light power supplier 17 to output the thickness erase light voltage to the erase light emitter 16.

It should be noted that in general, in a range of use of the LED elements used in the erase light emitter 16, amounts of light and voltage values correspond one-to-one, and the higher the voltage value, the greater the amount of light emitted by the erase light emitter 16. Accordingly, the amount of erase light is changed by changing the voltage that is output from the erase light power supplier 17 to the erase light emitter 16.

1-4. Erase Light and Thickness Decrease

FIG. 6 is a table showing a result of an endurance test for checking a difference in an amount of thickness decrease (d) depending on whether erase light is applied or not. The endurance test was performed by irradiating the photosensitive drums 11 with a predetermined amount of erase light in a range of 23.6-110 (μW) while rotating the photosensitive drums 11 without a sheet. The endurance sheet count represents the number of rotations of the photosensitive drum 11 using a number of sheets considered to have been processed under the assumption that sheets were actually used in the above-mentioned endurance test. In this specification, in embodiments of the present invention, the amount of erase light of the endurance test is set to be the same as the above, and the term "endurance sheet count" is used in the above-defined meaning. After the endurance test with the endurance sheet count of 600,000, in the case where no erase light was emitted, the thickness decreased by 1.2 μm, and in the case where erase light was applied, the thickness decreased by 3.6 μm. This indicates that the erase light caused light-induced fatigue and abrasion of the photoreceptor was accelerated as a result.

1-5. Control of Amount of Erase light based on Amount of Thickness Decrease

According to the structure employed in the present embodiment, the amount of thickness decrease (d) is detected for the photosensitive layer of each of the photosensitive drums 11C, 11M, 11Y, and 11K of the printer 100, and the amounts of erase light emitted to the photosensitive drums 11C, 11M, 11Y, and 11K are individually changed.

The amount of thickness decrease (d) is determined by subtracting the thickness of the photosensitive layer detected by the thickness detector 18 (see FIGS. 2 and 3) from the initial thickness.

In the present embodiment, when an image stabilization operation is executed, an predetermined voltage is applied to the photoreceptors to detect thickness decreases.

Note that the image stabilization operation is an operation to update control variables for image formation to optimal values according to changes of temperature and humidity in the image forming apparatus, deterioration of parts such as photosensitive drums, developer, and the like in order to maintain the image quality at a required predetermined level or higher. The image stabilization operation is executed such as when the image forming apparatus is powered-ON, the accumulated number of sheets for image formation completed reaches a predetermined value, a predetermined period of time has elapsed, or the temperature or the humidity has varied more than a predetermined amount.

FIG. 7 is a table showing a criterion for the CPU 51 (see FIG. 2) to determine the thickness erase light voltage based on the amount of thickness decrease (d) calculated from the result of the thickness detection performed by the thickness detector 18 (see FIGS. 2 and 3), and is a correspondence table showing a relationship between the amount of the erase light emitted onto a photosensitive drum 11 and the amount of thickness decrease (d). In the table shown in FIG. 7, the amounts of thickness decrease d1 and d2 satisfy a relationship of d1<d2, the amounts of erase light Er1, Er2, and Er3 satisfy a relationship of 23.6≦Er3<Er2<Er1≦110 (μW). Values of d1, d2, Vd1, Vd2, Vd3, Er1, Er2, and Er3 shown in FIG. 7 are determined by experiments or the like respectively.

Figure 8:
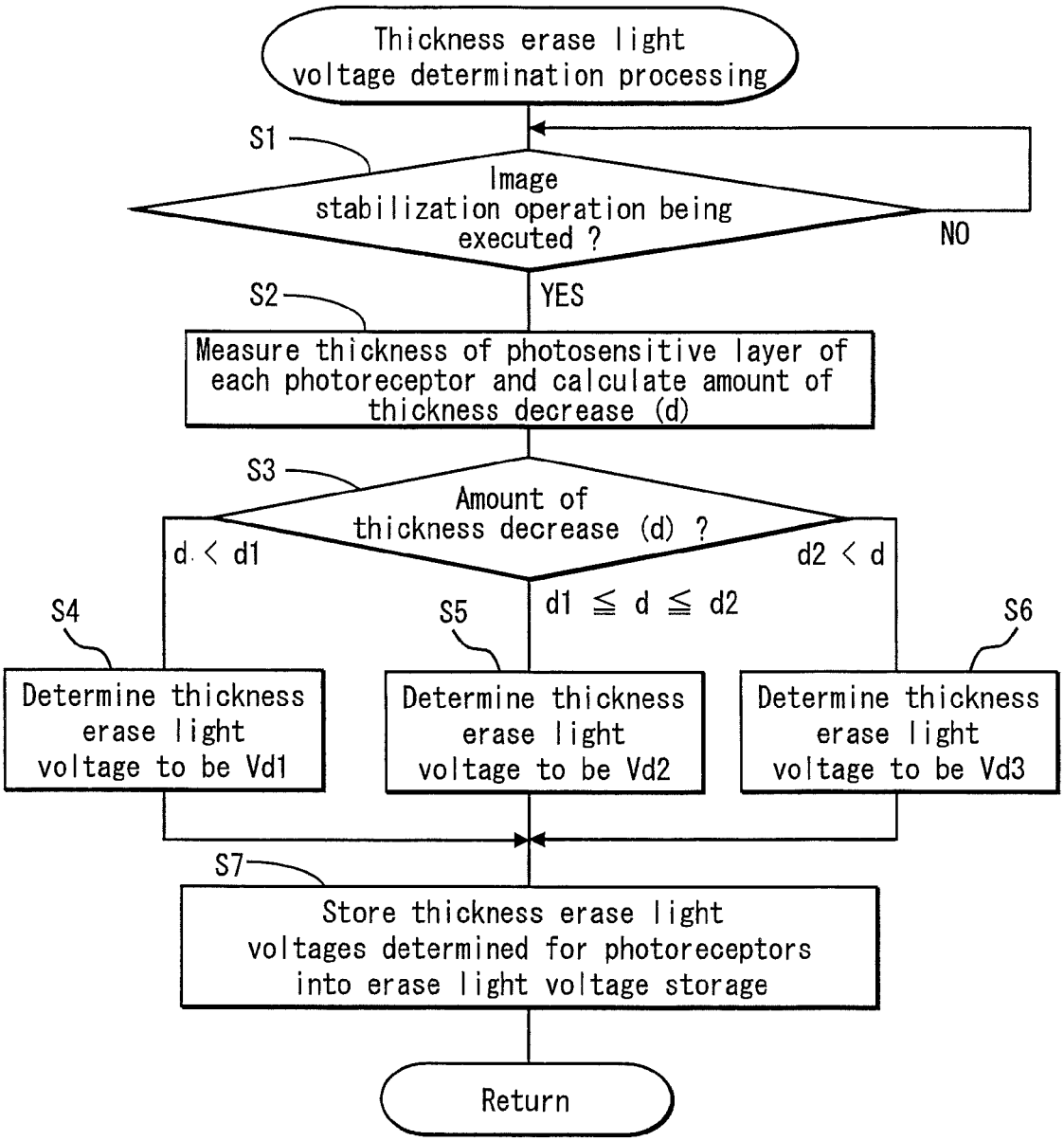
FIG. 8 is a flowchart showing a process operation of thickness erase light voltage determination processing in the first embodiment of the present invention.

FIG. 8 shows a flowchart showing an operation process for determining thickness erase light voltages. Note that a main routine (not shown) for controlling the entire printer 100 is stored in the ROM 53 (see FIG. 2), and the main routine is read from the ROM 53 by the CPU 51 and executed separately by the controller 50. Thickness erase light voltage determination processing is executed each time the sub-routine for the thickness erase light voltage determination processing is called from the main routine.

When the stabilization operation is executed, the thickness of the photosensitive layer of each of the photosensitive drums (photoreceptors) 11C, 11M, 11Y, and 11K is measured, the initial thickness of the photosensitive layer of each photosensitive drum stored in the initial thickness storage 56 (FIG. 2) is referred to, and the amount of thickness decrease (d) is calculated for the thickness of the photosensitive layer of each photosensitive drum (step S1: YES, step S2). When d is smaller than d1, the thickness erase light voltage is determined to be Vd1 (step S3: <d1, step S4). When d is equal to or greater than d1 and equal to or less than d2, the thickness erase light voltage is determined to be Vd2 (step S3: d1–d2, step S5). When d is greater than d2, the thickness erase light voltage is determined to be W13 (step S3: d2<, step S6). Each thickness erase light voltage determined in steps S3-S6 is stored in the erase light voltage storage 55 (see FIG. 2) (step S7) and the process returns to the main routine.

Figure 9:
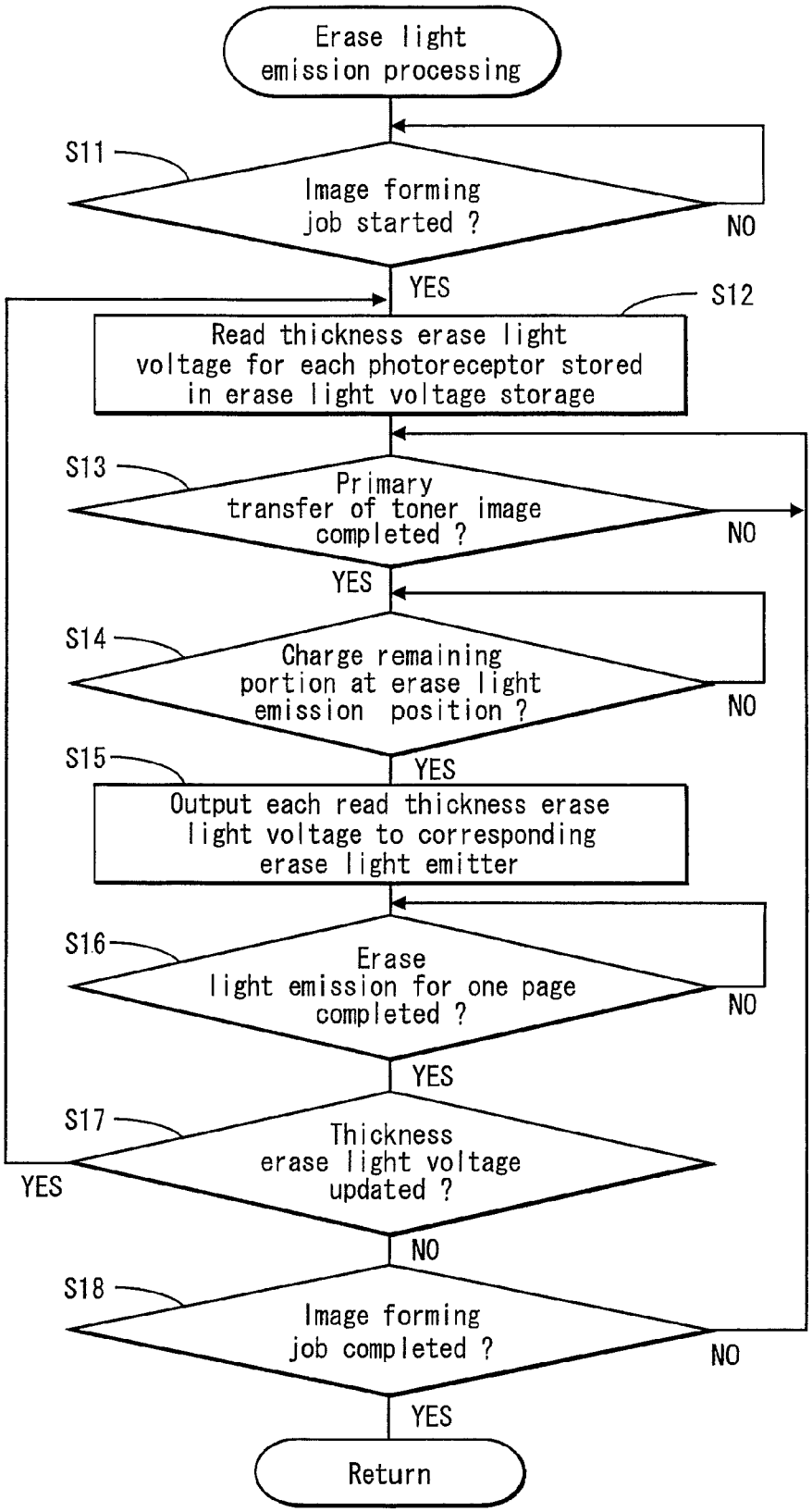
FIG. 9 is a flowchart showing a process operation of erase light emission processing in the first embodiment of the present invention.

FIG. 9 is a flowchart showing processing of erase light emission using the thickness erase light voltages determined in the thickness erase light voltage determination processing when an image forming job is executed. Note that the main routine (not shown) for controlling the entire printer 100 is stored in the ROM 53 (see FIG. 2), and the main routine is read from the ROM 53 by the CPU 51 and executed by the controller 50 separately. The above-mentioned processing is executed each time the sub-routine for the erase light emission processing is called from the main routine.

Upon the start of the image forming job, the thickness erase light voltage determined for each of the photosensitive drums (photoreceptors) 11C, 11M, 11Y, and 11K and stored in the erase light voltage storage 55 (see FIG. 2) is read (step S11: YES, step S12). Next, judgement is made as to whether the primary transfer of the toner image is completed or not. When the primary transfer of the toner image is not completed, the judgement continues as to whether the primary transfer of the toner image is completed or not (step S13: NO, step S13). When the primary transfer of the toner image is completed, judgement is made next as to whether the portion on the photoreceptor where the toner image was formed (in this specification, referred to as "charge remaining portion") has moved to an erase light emission position that is to be irradiated with the erase light emitted by the erase light emitter 16 (step S13: YES, step S14). When the charge remaining portion has not moved to the erase light emission position, the judgement continues as to whether the charge remaining portion has moved to the erase light emission position or not (step S14: NO, step S14). When the charge remaining portion has moved to the erase light emission position, each thickness erase light voltage read from the erase light voltage storage 55 in step S12 is output by the erase light power supplier 17 to the corresponding erase light emitter 16 which is arranged opposing the corresponding photosensitive drum 11 (step S14: YES, step S15).

Next, judgement is made as to whether erase light emission for one page is completed or not (step S16). When the erase light emission for one page is not completed, the judgement continues as to whether the erase light emission for one page is completed or not (step S16: NO, step S16). When the erase light emission for one page is completed, judgement is made next as to whether the thickness erase light voltages in the erase light voltage storage 55 have been updated or not (step S16: YES, step S17). When the thickness erase light voltages have been updated, the processing goes back to step S12, and the updated thickness erase light voltages are read from the erase light voltage storage 55 (step S17: YES, step S12). When the thickness erase light voltages have not been updated, judgement is made as to whether the image forming job is completed or not (step S17: NO, step S18).

When the image forming job is completed (step S18: YES), the processing returns to the main routine. When the image forming job is not completed, the routine goes back to step S13, judgement is made as to whether the primary transfer of toner image for the next page is completed or not (step S18: NO, step S13), and until the image forming job is judged to be completed in step S18, steps S13-S18 (steps S12-S18 in a case where the thickness erase light voltages have been updated before the image forming job is completed) are repeated.

Note that the judgement of whether the primary transfer of the toner image is completed in step S13 and the judgement of whether the charge remaining portions have moved to the erase light emission positions in step S14 can be made by counting rotation pulse signals of the drive motor (not shown) that drives the photosensitive drums 11 to drive.

Also, according to the present embodiment, the thickness is measured by detecting the potential of the surface of the photoreceptor when a predetermined voltage is applied. However, it is not limited to this, and the thickness may be measured with use of a noncontact thickness sensor using such as reflection spectroscopy or ultrasonic.

Furthermore, while in the present embodiment, each amount of thickness decrease (d) used for determining the thickness erase light voltage is classified into three levels, it is not limited to this, and the amount of thickness decrease (d) may be classified into two levels or more than three levels.

Additionally, in the present embodiment, each thickness is measured when the image stabilization operation is executed. However, it is not limited to this, the thickness may be measured at an arbitrary timing which does not hinder smooth execution of the image forming job. In this case, it is preferable to measure the thickness at an interval that is sufficiently shorter than a period of time considered to be equivalent to the lifetime of the photoreceptors and that does not exceed a period of time in which the thickness is assumed to decrease by an amount equivalent to one level, such as once a week or once a month.

As described above, according to the present embodiment, for each of the photosensitive drums 11, an amount of erase light corresponding to the degree of the photoreceptor memory that varies depending on the thickness of the photosensitive layer can be emitted. Accordingly, image deterioration due to the photoreceptor memory can be suppressed while the light-induced fatigue of the photoreceptor being also suppressed, which leads to a longer service life of the photoreceptor.

Also, since the greater the amount of thickness decrease with respect to the initial thickness, the smaller the degree of the photoreceptor memory, the photoreceptor memory of a small degree does not require intense erase light. Accordingly, extension of the lifetime of the photoreceptor can be achieved by reducing the amount of erase light, thereby suppressing the light-induced fatigue of the photoreceptor.

Second Embodiment

The first embodiment has described a structure in which the thickness of the photosensitive layer of each photosensitive drum is measured, and the amount of erase light to be emitted is changed in accordance with the amount of thickness decrease of the photosensitive layer of each photosensitive drum. On the other hand, according to the present embodiment, an environment sensor is provided in a vicinity of each photosensitive drum, and the amount of erase light to be emitted to each photosensitive drum is individually changed based on information on the absolute humidity obtained from a detection result of the corresponding environment sensor, in addition to the amount of thickness decrease. Note that in order to avoid explanatory repetition, explanation on the same content as the first embodiment is omitted, and the same components are assigned the same reference numerals.

2-1. Control on Amount of Erase Light Based on Temperature and Humidity

Environment sensors 70C, 70M, 70Y, and 70K (see FIGS. 2 and 3) are provided in the printer 100 in vicinities of the photosensitive drums 11C, 11M, 11Y, and 11K, respectively. The environment sensors 70C, 70M, 70Y, and 70K, each composed of a temperature sensor and a humidity sensor, detect the temperature and the humidity in the vicinities of the photosensitive drums 11C, 11M, 11Y, and 11K, respectively. Here, explanation is given on a structure that changes the amount of erase light using an environment step. The environment step is an index indicating a degree of the absolute humidity ($g/m^3$) obtained based on the temperature (° C.) and the relative humidity (%) detected by the environment sensors 70.

The CPU 51 determines a supply voltage to each erase light emitter 16 based on the following: the amount of thickness decrease calculated based on thickness information from the thickness detector 18 (see FIGS. 2 and 3); and an environment coefficient (described later) corresponding to the environment step (described later) which is the index of the absolute humidity determined from the temperature and the relative humidity detected by the environment sensors 70 (see FIGS. 1, 2, and 3). The CPU 51 then causes the determined voltage to be output from the erase light power supplier 17 to the erase light emitter 16.

FIG. 10 shows an example of a table for determining the environment step as the index indicating a degree of the absolute humidity. As shown in FIG. 10, in the present embodiment, the environment step is classified into eight levels from 1 to 8, for example. In the present embodiment, environment coefficients respectively corresponding to the environment steps are determined, and a voltage obtained by multiplying the thickness erase light voltage determined according to the amount of thickness decrease by the environment coefficient is output from the erase light power supplier 17 to the erase light emitter 16.

FIG. 11 shows a table for determining the environment coefficients. The environment coefficients K1-K8 correspond to the environment steps 1-8 on one-to-one basis, and satisfy the following relationship: $0<K8<K7<K6<K5<K4<K3<K2<K1=1$.

Note that the table of the environment steps shown in FIG. 10 is merely an example, and the classification is not limited to eight levels. Also, threshold values of the temperature and the humidity used for the classification of the environment step are not limited to the values of the temperature and the humidity shown in the table in FIG. 10. The number of levels for the classification of the environment steps and the threshold values of the temperature and the humidity in the classification are determined by experiments and the like with a degree of the photoreceptor memory, the decrease rate of the thickness, and the like taken into account.

Figure 12:
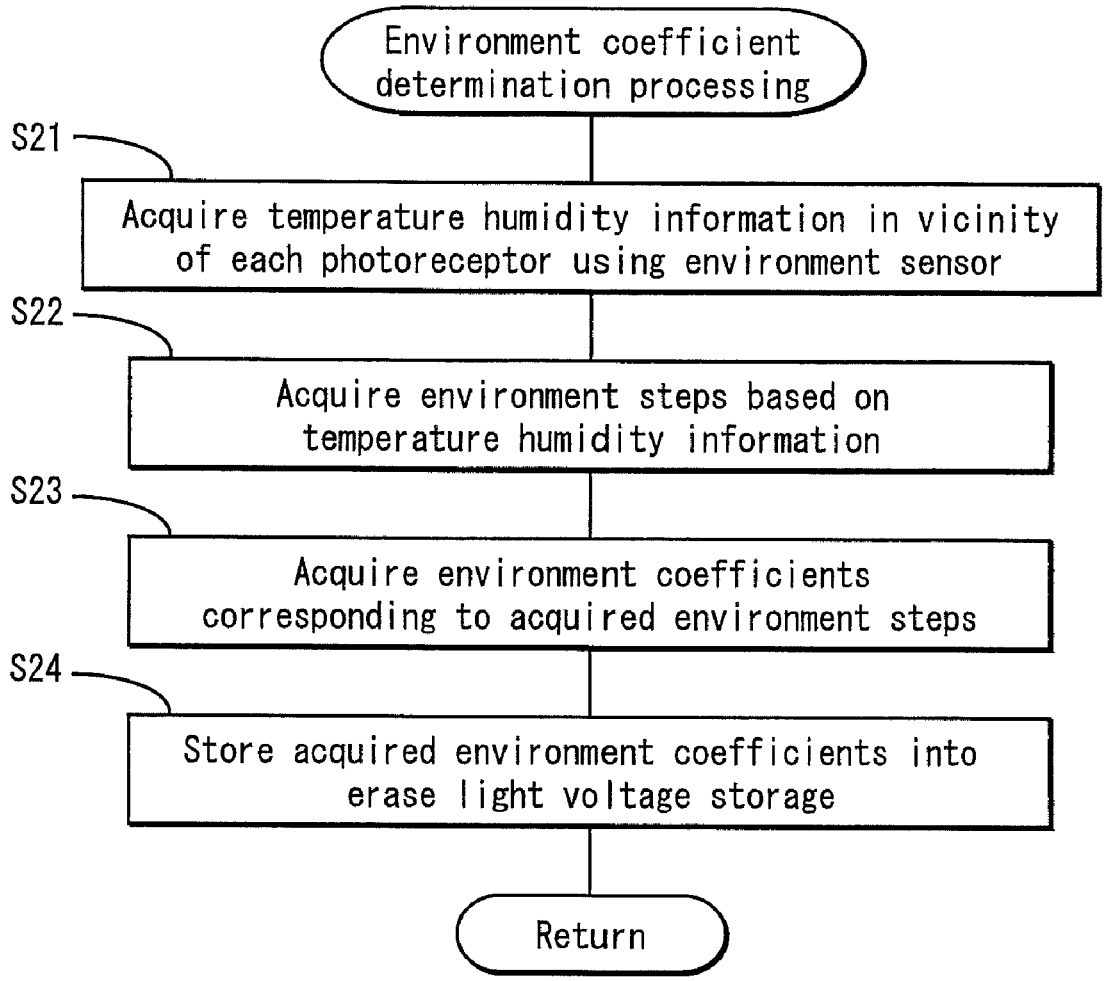
FIG. 12 is a flowchart showing a process operation of environment coefficient determination processing in the second embodiment of the present invention.

FIG. 12 shows a flowchart indicating an operation process of environment coefficient determination processing which determines environment coefficients in the present embodiment. Note that the environment coefficient determination processing is a sub-routine of the erase light emission processing (see FIG. 13), which is described later, and is executed each time the sub-routine of the environment coefficient determination processing is called in the erase light emission processing.

First, the environment sensors 70 provided in the vicinities of the photosensitive drums (photoreceptors) 11 each acquire temperature humidity information in the vicinity of the corresponding photosensitive drum 11. The table shown in FIG. 10 is referred to, and an associated environment step is acquired for each piece of temperature humidity information (step S21, step S22). Next, an associated environment coefficient is acquired from the table shown in FIG. 11 for each of the acquired environment steps. Following that, the acquired environment coefficients corresponding to the photosensitive drums 11 are stored in the erase light voltage storage 55 (step S23, step S24), and the processing returns to the flow of the erase light emission processing.

Figure 13:
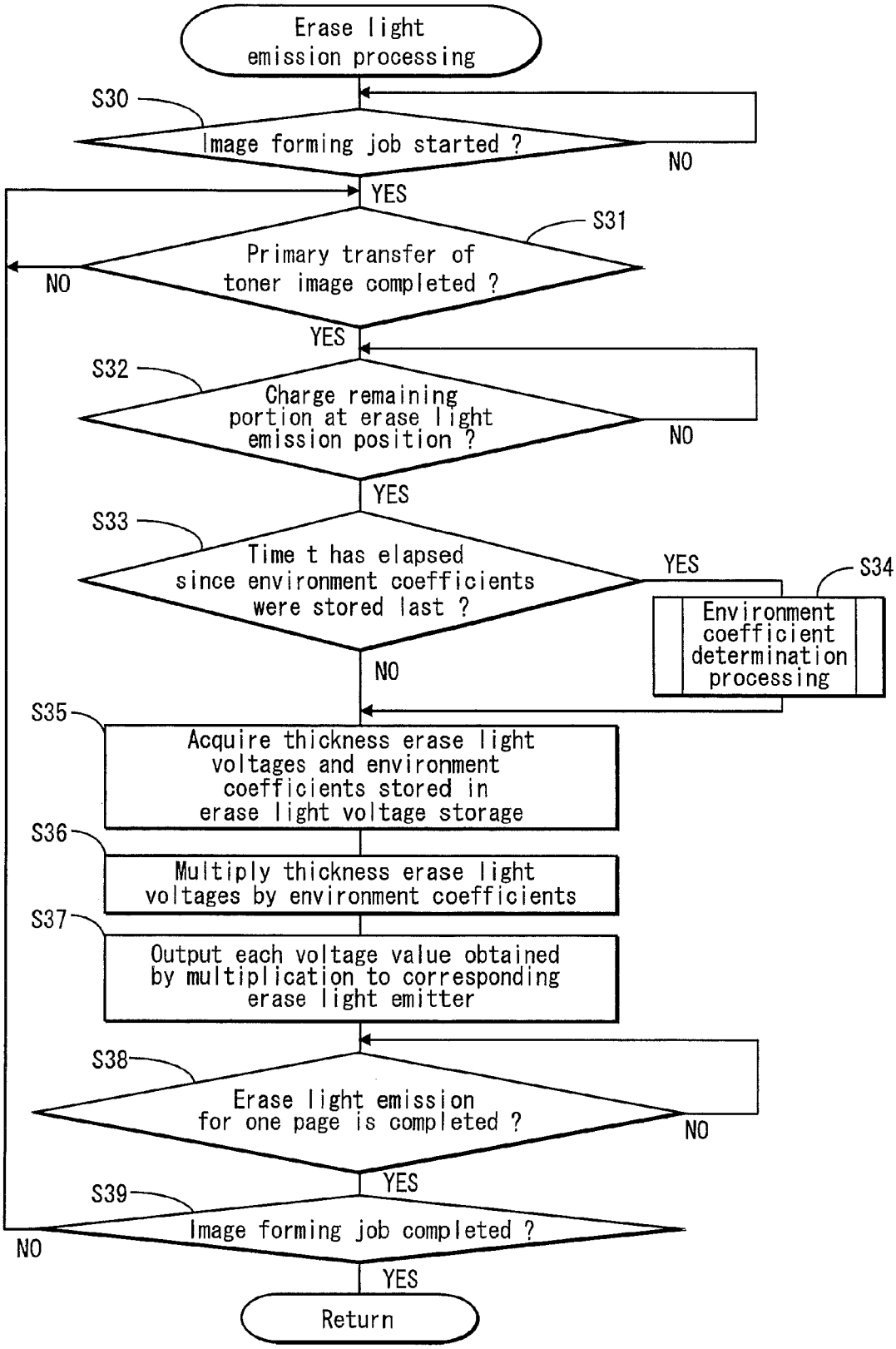
FIG. 13 is a flowchart showing a process operation of erase light emission processing in the second embodiment of the present invention.

FIG. 13 is a flowchart showing the operation process of the erase light emission processing in the present embodiment. Note that the main routine (not shown) for controlling the entire printer 100 is stored in the ROM 53 (see FIG. 2), and the main routine is read from the ROM 53 by the CPU 51 and executed by the controller 50 separately. The erase light emission processing is executed each time the sub-routine of the erase light emission processing is called from the main routine.

Upon receiving an image forming job, judgement is made as to whether the primary transfer of the toner image is completed or not (step S30: YES, step S31). When the primary transfer of the toner image is not completed, the judgement continues as to whether the primary transfer of the toner image is completed or not (step S31: NO, step S31). When the primary transfer of the toner image is completed, judgement is made next as to whether the charge remaining portion has moved to an erase light emission position that is to be irradiated with the erase light emitted by the erase light emitter 16 (step S31: YES, step S32). When the charge remaining portion has not moved to the erase light emission position, the judgement continues as to whether the charge remaining portion has moved to the erase light emission position or not (step S32: NO, step S32). When the charge remaining portion has moved to the erase light emission position, judgement is made as to whether a time t has elapsed since environment coefficients were stored in the erase light voltage storage 55 last (step S32: YES, step S33). Here, although not particularly limited, the time t is preferably a period of time in which a significant change for the determination of the environment step is likely to occur in the environment in terms of temperature and humidity in the vicinities of the photosensitive drums 11, and for example, may be approximately 10 minutes.

When the time t has not elapsed, it is judged that no significant change has occurred in the temperature humidity environment in the vicinities of the photosensitive drums 11 since the last acquisition of the environment step, and the environment coefficients and the thickness erase light voltages stored in the erase light voltage storage 55 that correspond to the photosensitive drums 11 and that were acquired last time are acquired (step S33: No, step S35).

When the time t has elapsed, it is judged that it is likely that a significant change has occurred in the temperature humidity environment in the vicinities of the photosensitive drums 11 since the last acquisition of the environment, and the sub-routine of the environment coefficient determination processing shown in FIG. 12 is executed (step S33: YES, step S34). In the sub-routine of the environment coefficient determination processing, new environment steps are acquired, and environment coefficients corresponding to the new environment steps are stored (updated) in the erase light voltage storage 55. Next, the environment coefficients and the thickness erase light voltages updated in step 34 are acquired from the erase light voltage storage 55 (step S35).

Subsequently, the thickness erase light voltages acquired in step S35 are each multiplied by the associated environment coefficient, and voltages obtained by the multiplications are respectively output from the erase light power supplier 17 to the erase light emitters 16 (step S36, step S37). Next, it is judged whether erase light emission for one page is completed or not, and when the erase light emission for one page is not completed, the judgement step is repeatedly performed (step S38: NO, step S38). When the erase light emission for one page is completed, it is judged whether the image forming job is completed or not (step S38: YES, step S39). When the image forming job is not completed, the processing goes back to S31 (step S39: NO, step S31), and steps S31-S39 are repeated. When the image forming job is completed (step S39: YES), the processing returns to the main routine.

Note that the judging step of whether the charge remaining portions have moved to erase light emission positions in step S32 is not limited to being executed at the above-described timing, and may be executed at any timing from immediately after step S31 to immediately before step S37 except between the end of step S33 and the beginning of step S34, and between the end of step S34 and the beginning of step S35.

Note that the judgement of whether the primary transfer of the toner image is completed in step S31 and the judgement of whether the charge remaining portions have moved to the erase light emission positions in step S32 can be made by counting rotation pulse signals of the drive motor (not shown) that drives the photosensitive drums 11 to drive.

Furthermore, the tables shown in FIGS. 10 and 11 are pre-stored in a nonvolatile memory such as the ROM 53, and are read from the nonvolatile memory as required.

As described in the present embodiment, the lifetime of the photoreceptors can be extended in the following manner: the higher the absolute humidity, the lower the degree of the photoreceptor memory and thus does not require intense erase light; accordingly, the temperature and the humidity in a vicinity of each of the photosensitive drums 11 are detected, the environment step as the index indicating the degree of the absolute humidity is determined based on these two detection results, and the amount of the erase light is reduced according to the determined environment step. As a result, the light-induced fatigue of the photoreceptor is suppressed.

Also, as described in the present embodiment, a more detailed control can be performed on the amount of erase light emitted to each photosensitive drum 11 by changing the amount of erase light to be emitted to each photosensitive drum 11 using the above-described environment step, in addition to the amount of thickness decrease of the photoreceptor of the photosensitive drums 11. Consequently, occurrence of the light-induced fatigue of the photoreceptor can be suppressed more efficiently, thereby realizing extension of the lifetime of the individual photoreceptor more efficiently.

Third Embodiment

3-1. Control of Amount of Erase Light Based on Color of Toner

The photoreceptor memory occurs due to electric charge remaining on the photosensitive drum 11 after a transfer. However, noticeability of the image deterioration differs depending on the color of the toner even if the amount of remaining electric charge is the same. Accordingly, the resulting image deterioration varies in degree as well. In the present embodiment, explanation is given on a structure that changes the amount of erase light depending on the color of the toner provided to the photosensitive drum 11. Note that in order to avoid explanatory repetition, explanation on the same content as the first embodiment is omitted, and the same components are assigned the same reference numerals.

Image deterioration due to the photoreceptor memory varies in degree of noticeability even if the electric intensity of the photoreceptor memory is the same. For example, the Y-color (yellow) is not very noticeable, while the C-color (cyan), the M-color (magenta), and the K-color (black) are more noticeable than the Y-color.

Accordingly, the lifetime of the photosensitive drum 11Y can be extended by reducing the amount of erase light applied to the photosensitive drum 11Y which uses the Y-color toner in which image deterioration due to the photoreceptor memory is least noticeable.

Specific details are given below. When a voltage Vo is output to the erase light emitters 16C, 16M, and 16K corresponding to the photosensitive drums 11C, 11M, and 11K for the colors other than the Y-color, i.e., the C-color, the M-color, and the K-color, a voltage Vy that is lower than Vo is output from the erase light power supplier 17 to the erase light emitter 16Y for the photosensitive drum 11Y for the Y-color. Note that the value of the voltage Vy is predetermined by experiments and the like to be in a range such that the image deterioration due to the photoreceptor memory is acceptable, and is stored in a nonvolatile memory such as the ROM 53.

As described above in the present embodiment, image deterioration due to the photoreceptor memory is least noticeable in the Y-color, and accordingly, the degree of the photoreceptor memory causing the acceptable degree of the image deterioration is greater than that in the other toner colors. Consequently, the amount of erase light emitted to the photosensitive drum 11Y for the Y-color can be reduced compared with that emitted to the photosensitive drums 11C, 11M, and 11K for the other colors. As a result, the light-induced fatigue of the photoreceptor 11Y is suppressed, thereby achieving extension of the photoreceptor 11Y.

Fourth Embodiment

4-1. Position of Photosensitive Drum and Thickness Decrease

Figure 14:
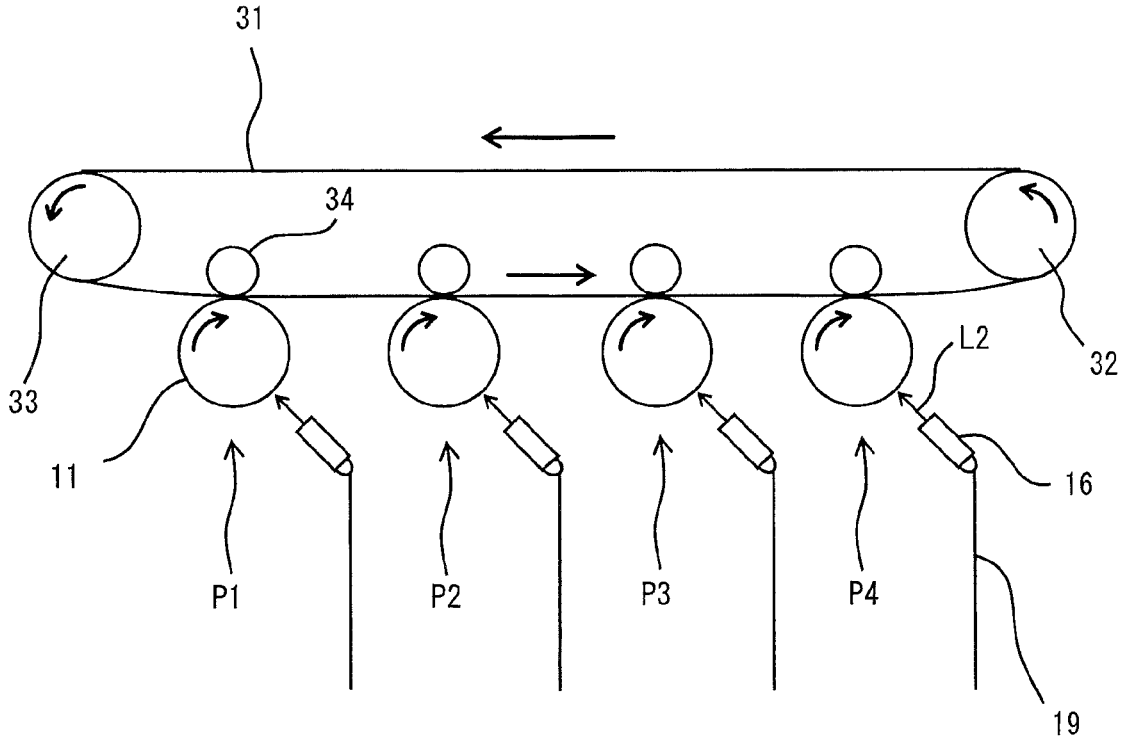
FIG. 14 is a plane view showing a positional relationship among an intermediate transfer belt, photosensitive drums, and erase light emitters.

In the tandem-type digital color printer, as shown in FIG. 14, the four photosensitive drums 11 respectively corresponding to the colors of C, M, Y, and K are arranged substantially in alignment below the intermediate transfer belt in a manner that the axes of the photosensitive drums 11 intersect perpendicularly with the rotating direction of the intermediate transfer belt 31. When the positions of these four photosensitive drums are referred to as P1, P2, P3, and P4 from upstream at a toner transfer position in the rotating direction of the intermediate transfer belt 31, in general, the photosensitive drums 11 of the respective colors are positioned as follows: Y at P1, M at P2, C at P3, and K at P4. Note that bold arrows in the figure without a reference numeral show directions in which the rollers, photosensitive drums, and the intermediate transfer belt are driven to rotate.

A chart in FIG. 15 shows results of an endurance test in which the photosensitive drums 11 are sequentially arranged from the upstream in an order of Y, M, C, and K, and results of an endurance test in which the positions of the photosensitive drums 11Y and 11C are interchanged. An endurance test of endurance sheet count 20,000 was performed in Case 1 and Case 2 shown in the table in FIG. 15. In Case 1, the photosensitive drums 11 were arranged in the normal order of Y, M, C, and K from the upstream; and in Case 2, the photosensitive drums 11 were arranged in the order of C, M, Y, and K from the upstream, with Y and C interchanged with respect to the order in Case 1. As shown in the chart, in both of Case 1 and Case 2, the thickness of the photosensitive layer of the photosensitive drum 11 at the P1 position, that is, the photosensitive drum 11 that is positioned at the left end in FIG. 14 or that transfers the image onto the intermediate transfer belt 31 at the earliest timing decreased most. This indicates that the thickness decrease rate of each photoreceptor obtained by dividing the decrease amount of the photosensitive layer with respect to the initial thickness by an elapsed time is the greatest at the photoreceptor positioned most upstream.

4-2. Position of Photosensitive Drum and Erase Light Voltage

The results of the above-described endurance tests showed the following tendency: irrespective of the color of the toner, the thickness decrease rate of the photosensitive drum 11 positioned at the left end in FIG. 14 or of the photosensitive drum 11 that transfers the image onto the intermediate transfer belt 31 at the earliest timing was the greatest. Accordingly, reducing the amount of erase light emitted to the photosensitive drum 11 positioned at P1 to be lower than the amount of erase light emitted to the other photosensitive drums 11 leads to suppression of light-induced fatigue of the photoreceptor of the photosensitive drum 11 at P1. As a result, the lifetime of the photoreceptor is extended. More specifically, when the voltage output to the erase light emitters 16 of the photosensitive drums 11 positioned at P2, P3, and P4 is Vo, a voltage Vp1 that is lower than Vo is output to the erase light emitter 16 of the photosensitive drum 11 at P1 from the erase light power supplier 17. With this structure, a difference between the lifetime of the photoreceptor at P1 and the lifetime of the photoreceptors at other than P1 can be reduced. As a result, replacement timings for the four photosensitive drums 11 can be adjusted to be close with one another, reducing the frequency of replacement of the photoreceptors, thereby contributing to user-convenience.

Note that a value of the voltage Vp1 is predetermined by experiments and the like to be in a range such that the image deterioration due to the photoreceptor memory is acceptable, and is stored in a nonvolatile memory such as the ROM 53.

Additionally, if the photosensitive drum 11 disposed at the position P1 is, for example, for the K-color, outputting, from the beginning, the voltage Vp1 that is lower than Vo leads to occurrence of noticeable image deterioration due to the photoreceptor memory. Accordingly, in this case, in view of the third embodiment, it is most effective to dispose the photosensitive drum 11 for the Y-color at the position P1, as the image deterioration due to the photoreceptor memory is least noticeable this way and at the same time the lifetime of the photoreceptor can be extended.

Fifth Embodiment

5-1. Degree of Photoreceptor Memory According to Sheet Type

In the present embodiment, explanation is given on a structure that changes the amount of erase light according to the type of the sheet S onto which the toner images are to be transferred. Note that in order to avoid explanatory repetition, explanation on the same content as the first embodiment is omitted, and the same components are assigned the same reference numerals.

In general, image forming apparatuses using an electrophotographic system change the process speed of image formation depending on whether it is for a thick sheet whose basis weight is not lower than 120 (g/m$^2$), or a plain sheet/thin sheet whose basis weight is lower than 120 (g/m$^2$). That is, in a case of a thick sheet, the process speed is set lower than in a case of a plain sheet/thin sheet. More specifically, the sheet convey speed is, for example, 165 (mm/s) in a plain sheet/thin sheet mode, while it is 55 (mm/s) in a thick sheet mode. This is because a thick sheet has a higher heat capacity, and accordingly, during fixing, a longer period of time is required for the temperature of the surface of the thick sheet to rise up to the temperature at which the toner melts. Here, the process speed is a speed at which a series of image forming operations are performed by the printer 100.

In the thick sheet mode, because the process speed is slow, the rotational speed of the photosensitive drums 11 is also slow in accordance with the process speed. Thus, it takes longer for the charge remaining portions on the photosensitive drums 11 to move to the erase light emission positions after the transfer. This leads to a larger fall in the potential of the photoreceptor memory due to dark decay, resulting in the photoreceptor memory becoming smaller. Accordingly, it can be assumed that in the thick sheet mode, even when the amount of erase light is reduced compared with the plain sheet/thin sheet mode, image deterioration is less noticeable. As a result, the lifetime of the photosensitive drums 11 can be extended while the image deterioration is also suppressed.

More specifically, when a voltage output to the erase light emitters 16 in the plain sheet/thin sheet mode is Vp, a voltage Vt that is lower than Vp is output from the erase light power supplier 17 to the erase light emitters 16 in the thick sheet mode.

The CPU 51 (see FIG. 2) determines the supply voltage to the erase light emitters 16 according to the sheet type judged by a sheet type judgement part 71 (see FIG. 2), and causes the determined voltage to be output from the erase light power supplier 17 to the erase light emitters 16.

5-2. Control of Amount of Erase Light According to Sheet Type

Figure 16:
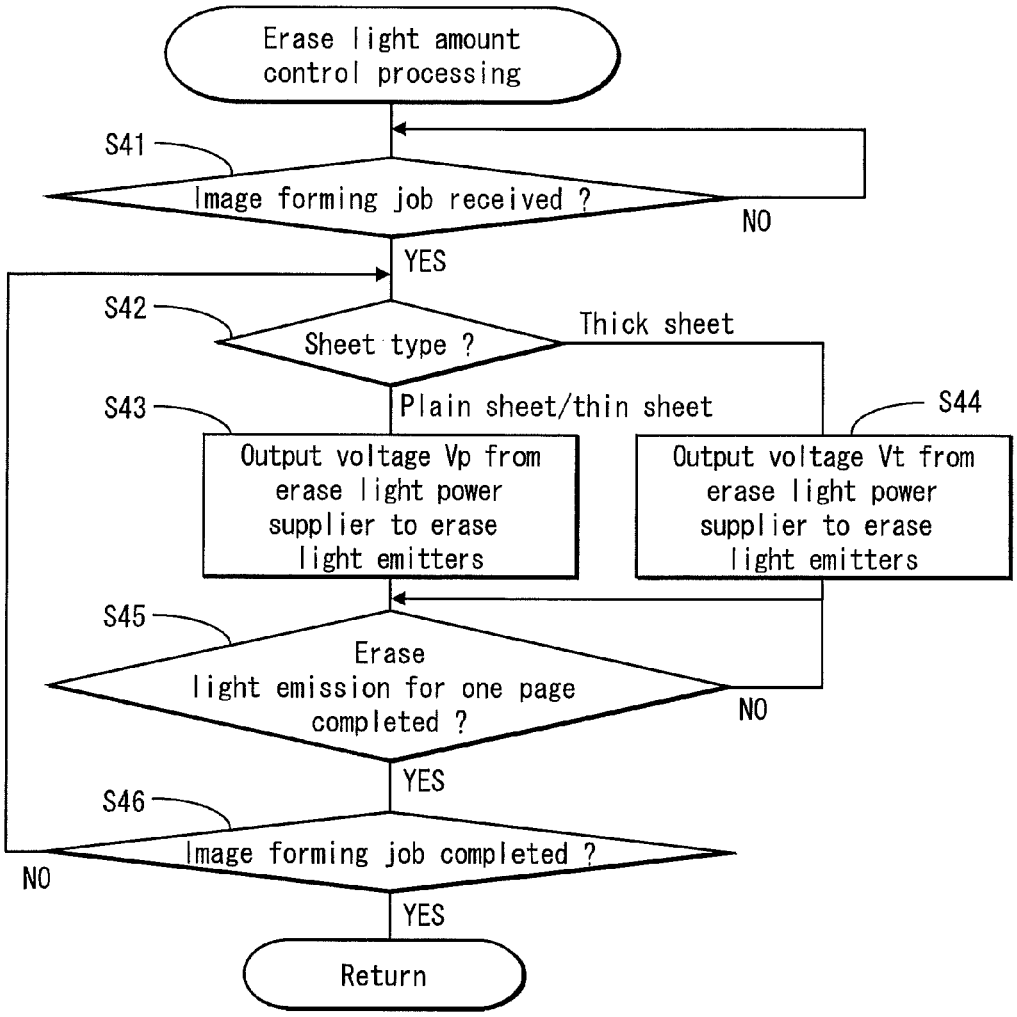
FIG. 16 is a flowchart showing a process operation of erase light emission processing in a fifth embodiment of the present invention.

FIG. 16 is a flowchart showing an operation process of erase light amount control processing that changes the amount of erase light according to the sheet type in the present embodiment. Note that the main routine (not shown) for controlling the entire printer 100 is stored in the ROM 53 (see FIG. 2), and the main routine is read from the ROM 53 by the CPU 51 and executed separately by the controller 50. The erase light amount control processing is executed each time the sub-routine for the erase light amount control processing is called from the main routine.

First, upon receiving a print job, the sheet type is judged (step S41: YES, step S42). When the sheet type is plain sheet or thin sheet, the voltage Vp is output from the erase light power supplier 17 to the erase light emitters 16 (step S42: plain sheet/thin sheet, step S43). When the sheet type is thick sheet, the voltage Vt is output from the erase light power supplier 17 to the erase light emitters 16 (step S42: thick sheet, step S44). Next, it is judged whether erase light emission for one page is completed or not, and when the erase light emission for one page is not completed, the judgement step is repeatedly performed (step S45: NO, step S45). When the erase light emission for one page is completed, it is judged whether the image forming job is completed or not (step S45: YES, step S46). When the print job is completed (step S46: YES), the processing returns to the main routine. When the print job is not completed, the process goes back to step S42 and the sheet type is judged (step S46: NO, step S42), and steps from S42 to S46 are repeated until the image forming job is judged to be completed in step S46.

According to the flowchart above, when it is judged that the image forming job is not completed in step S46, the process goes back to step S42 and the sheet type is judged again. However, the structure is not limited to this, and a structure such as follows may be adopted: that is, in case of a printer that cannot use different types of recording sheets in one image forming job, the sheet type is not judged each time erase light emission for one page is completed; instead, an erase light voltage corresponding to the sheet type judged in step S42 is temporarily stored in a memory such as the RAM 54 and the stored erase light voltage is output from the erase light emitter 16 until the image forming job being executed is completed.

Note that values of the voltages Vp and Vt are determined in advance by experiments or the like to be within a range such that the image deterioration due to a photoreceptor memory is acceptable, and is stored in a nonvolatile memory such as the ROM 53. Also, the judgement of the sheet type by the sheet type judgement part 71 is performed by detecting a selection of a paper feed tray by the user received on the operation panel 2, or a selection of a paper feed tray included in a print job execution instruction issued by a user using a terminal, for example, a PC connected with the printer 100 via a network such as LAN.

As described above, the slower the process speed determined based on the sheet type according to the basis weight of the sheet, the longer a period of time required for an image forming position on the photosensitive drum 11 to move from the transfer position to the charging position. Accordingly, the decrease of the electric charge remaining on the photoreceptor after the transfer due to dark decay becomes greater, and as a result, the photoreceptor memory becomes smaller. Thus, in this case, the lifetime of the photoreceptor can be extended by reducing the amount of erase light, thereby suppressing the light-induced fatigue of the photoreceptor.

Note that the structure of the present embodiment that changes the amount of erase light according to the sheet type may be also applied to a monochrome printer having one photosensitive drum. In this case also, the lifetime of the photoreceptor can be extended by suppressing light-induced fatigue of the photoreceptor in a similar manner.

MODIFICATIONS

Up to now, the present invention has been described based on the embodiments. However, it is obvious that the present invention is not limited to the above embodiments, and the following modifications can be implemented.

(1) In the fourth embodiment, explanation has been given on the structure that reduces the amount of erase light emitted to the photosensitive drum 11Y for the Y-color in which the image deterioration due to the photoreceptor memory is least noticeable. However, the structure is not limited to this, and for example, may be as follows: assume that the voltage Vo output to the erase light emitter 16 of the photosensitive drum 11K for the K-color in which the image deterioration due to the photoreceptor memory is most noticeable, voltages $\alpha c$Vo, $\alpha m$Vo, $\alpha y$Vo, and $\alpha k$Vo (=Vo) respectively obtained by multiplying Vo by coefficients $\alpha c$, $\alpha m$, $\alpha y$, and $\alpha k$ ($0<\alpha y<\alpha c$, $\alpha m \leqq \alpha k=1$) may be emitted to the erase light emitters 16C, 16M, 16Y, and 16K for the colors C, M, Y, and K, respectively. With this structure, timings for replacement of the photosensitive drums 11 for three colors (C, M, Y) or for four colors (C, M, Y, K) can be coordinated to be close with one another so that the photosensitive drums 11 of the respective colors can be replaced at the same time. As a result, the replacement frequency decreases, contributing to user-convenience. Note that for ac, $\alpha m$, and $\alpha y$, values are determined by experiments or the like in advance to be within a range such that the image deterioration due to the photoreceptor memory is acceptable, and are stored in the nonvolatile memory such as the ROM 53.

(2) In the fifth embodiment, the same voltage Vt is output from the erase light power supplier 17 to all of the four erase light emitters 16 in the thick sheet mode. However, the structure is not limited to this and, for example, may be as follows instead: voltages obtained by respectively multiplying Vt by the coefficients $\alpha c$, $\alpha m$, $\alpha y$, and $\alpha k$ used in the modification (1) above may be output from the erase light power supplier 17 to the corresponding erase light emitters 16. With this structure, not only the lifetime of the photosensitive drums 11 can be lengthened more efficiently, but also timings for replacement of the photosensitive drums 11 for three colors (C, M, Y) or for four colors (C, M, Y, K) can be lined up to be close with one another so that the photosensitive drums 11 of the respective colors can be replaced at the same time. As a result, the replacement frequency decreases, contributing to user-convenience.

Each structure shown in diagrams and charts pertaining to the embodiments above is merely an example, and as long as the effects of the embodiments and the modifications can be realized, the structure does not need to be configured entirely as shown.

Note that a program that can cause a computer to execute the operations in the embodiments and the modifications above may be recorded to a computer-readable recording medium, for example, a magnetic tape, a magnetic disk such as a flexible disk, an optical recording medium such as CD-ROM, DVD-ROM, MO, or PD, or a flash-memory-type recording medium such as Smart Media (registered trademark), or COMPACTFLASH (registered trademark). The program may be produced and transferred in the form of the recording medium, and may also be transmitted or distributed via various wired or wireless networks (such as the Internet), broadcast, telecommunication lines, satellite communication, and the like.

Also, the present invention may be any combination of the above embodiments and the modifications.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming apparatus comprising:

an erase light emitter operable to emit, onto each of the photoreceptors, erase light for neutralizing electric charge remaining on a surface of the photoreceptor after transfer, wherein an amount of the erase light emitted onto the photoreceptor is determined based on a predetermined condition pertaining to a thickness of a photosensitive layer of the photoreceptor.

2. The image forming apparatus of claim 1 further comprising:

a first detector operable to detect the thickness of the photosensitive layer of each of the photoreceptors, wherein the predetermined condition pertaining to the thickness is a decrease amount by which the thickness of the photosensitive layer detected by the first detector has decreased with respect to an initial thickness thereof.

3. The image forming apparatus of claim 2, wherein the greater the decrease amount, the smaller the amount of the erase light emitted by the erase light emitter.

4. The image forming apparatus of claim 2 further comprising:

a second detector operable to detect a temperature and a relative humidity in a vicinity of each of the photoreceptors, wherein the amount of the erase light emitted by the erase light emitter is determined by adjusting an amount of erase light determined based on a result of detection by the first detector, according to an absolute humidity in the vicinity of the photoreceptor obtained based on a result of detection by the second detector.

5. The image forming apparatus of claim 4, wherein the higher the absolute humidity, the lower the amount of the erase light emitted by the erase light emitter.

6. The image forming apparatus of claim 1, wherein the predetermined condition is a position of the photoreceptor, and the amount of the erase light emitted onto one of the photoreceptors that is disposed at a position where a decrease rate is greatest among positions of the photoreceptors is lower than the amount of the erase light emitted onto any other of the photoreceptors, the decrease rate being obtained by dividing the decrease amount of the photosensitive layer by an elapsed time.

7. The image forming apparatus of claim 6 further comprising:

an intermediate transfer belt onto which the toner images formed on the photoreceptors are transferred, wherein the photoreceptors are disposed along a moving direction of the intermediate transfer belt, and the position where the decrease rate is greatest is most upstream among the positions of the photoreceptors in the moving direction at a toner transfer position of the intermediate transfer belt.

8. An image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming apparatus comprising:

an erase light emitter operable to emit, onto each of the photoreceptors, erase light for neutralizing electric charge remaining on a surface of the photoreceptor after transfer, wherein an amount of the erase light emitted onto one of the photoreceptors, on which a toner image in yellow is formed is lower than an amount of the erase light emitted onto any other of the photoreceptors on which a toner image in a color other than yellow is formed.

9. An image forming apparatus that forms a latent image on a photoreceptor based on image data, generates a toner image by developing the latent image using a toner, and transfers the toner image onto a transfer material, the image forming apparatus comprising:

an erase light emitter operable to emit, onto the photoreceptor, erase light for neutralizing electric charge remaining on a surface of the photoreceptor after transfer, wherein an amount of the erase light is determined based on a process speed of image formation, and the amount of the erase light is decreased if the process speed of image formation is decreased.

10. The image forming apparatus of claim 9 further comprising:

a sheet type judgment part operable to judge a type of a recording sheet onto which the toner image is to be transferred and fixed, wherein the process speed is determined according to the judged type of the recording sheet.

11. The image forming apparatus of claim 10, wherein the type of the recording sheet is determined according to a basis weight of the recording sheet, and when the basis weight of the recording sheet is equal to or higher than a predetermined threshold value, the amount of the erase light is lower than an amount of the erase light emitted when the basis weight of the recording sheet is lower than the threshold value.

12. An image forming unit in an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming unit comprising:

an erase light emitter operable to emit, onto each of the photoreceptors, erase light for neutralizing electric charge remaining on a surface of the photoreceptor after transfer, wherein an amount of the erase light emitted onto the photoreceptor is determined based on a predetermined condition pertaining to a thickness of a photosensitive layer of the photoreceptor.

13. An image forming unit in an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the image forming unit comprising:

an erase light emitter operable to emit, onto each of the photoreceptors, erase light for neutralizing electric charge remaining on a surface of the photoreceptor after transfer, wherein an amount of the erase light emitted onto one of the photoreceptors, on which a toner image in yellow is formed is lower than an amount of the erase light emitted onto any other of the photoreceptors on which a toner image in a color other than yellow is formed.

14. An image forming unit in an image forming apparatus that forms a latent image on a photoreceptor based on image data, generates a toner image by developing the latent image using a toner, and transfers the toner image onto a transfer material, the image forming unit comprising:

an erase light emitter operable to emit, onto the photoreceptor, erase light for neutralizing electric charge remaining on a surface of the photoreceptor after transfer, wherein an amount of the erase light is determined based on a process speed of image formation, and the amount of the erase light is decreased if the process speed of image formation is decreased.

15. An erase light control method executed by an image forming apparatus that forms a latent image on each of a plurality of photoreceptors based on image data, generates toner images by developing the latent images using toners of different colors, respectively, and transfers the toner images of the respective colors by superimposing the toner images at a same position on a transfer material, the erase light control method comprising:

a determining step of determining, for each of the photoreceptors, an amount of erase light for neutralizing electric charge remaining on a surface of the photoreceptor after transfer, in accordance with a predetermined condition pertaining to a thickness of a photosensitive layer of the photoreceptor; and an erase light emitting step of emitting, onto each of the photoreceptors, the amount of the erase light determined in the determining step.

16. The erase light control method of claim 15 further comprising:

a first detecting step of detecting the thickness of the photosensitive layer of each of the photoreceptors, wherein the predetermined condition pertaining to the thickness is a decrease amount by which the thickness of the photosensitive layer detected in the first detecting step has decreased with respect to an initial thickness thereof.

17. The erase light control method of claim 16, wherein the determining step determines the amount of the erase light in a manner that the greater the decrease amount, the smaller the amount of the erase light emitted in the erase light emitting step.

18. The erase light control method of claim 16, wherein the determining step further includes:

a second detecting step of detecting a temperature and a relative humidity in a vicinity of each of the photoreceptors;

an absolute humidity calculating step of calculating an absolute humidity in the vicinity of each of the photoreceptors based on a result of detection in the second detecting step; and an adjusting step of adjusting, according to the absolute humidity, the amount of the erase light determined based on the result of the detection in the first detecting step.

19. The erase light control method of claim 18, wherein the adjusting step adjusts the amount of the erase light in a manner that the higher the absolute humidity, the lower the amount of the erase light emitted in the erase light emitting step.

20. An erase light control method executed by an image forming apparatus that forms a latent image on a photoreceptor based on image data, generates a toner image by developing the latent image using a toner, and transfers the toner image onto a transfer material, the erase light control method comprising:

a determining step of determining an amount of erase light for neutralizing electric charge remaining on a surface of the photoreceptor after transfer, in accordance with a process speed of image formation, wherein the amount of the erase light is decreased if the process speed of image formation is decreased, and an erase light emitting step of emitting the amount of the erase light determined in the determining step.

21. The erase light control method of claim 20 further comprising:

the determining step further includes:

a sheet type judging step of judging a type of a recording sheet onto which the toner image is to be transferred and fixed, wherein the process speed is determined according to the judged type of the recording sheet.

22. The erase light control method of claim 20, wherein a sheet type judging step judges a type of the recording sheet according to a basis weight of the recording sheet, and when the basis weight of the recording sheet is equal to or higher than a predetermined threshold value, the determining step determines the amount of the erase light to be lower than an amount of the erase light emitted when the basis weight of the recording sheet is lower than the threshold value.

* * * * *